United States Patent [19]

Hänni et al.

[11] Patent Number: 4,644,834

[45] Date of Patent: Feb. 24, 1987

[54] APPARATUS FOR POSITIONING OF SHEET METAL PLATES ARRANGED ON A METAL FEED TABLE OF A METAL SHEAR

[75] Inventors: Eduard Hänni, Zofingen; Marcus Zweili, Basel, both of Switzerland

[73] Assignee: Hammerle AG, Zofingen, Switzerland

[21] Appl. No.: 696,318

[22] Filed: Jan. 30, 1985

[30] Foreign Application Priority Data

Jan. 30, 1984 [AT] Austria ..... 295/84

[51] Int. Cl.[4] ..... B26D 7/02

[52] U.S. Cl. ..... 83/415; 83/447; 83/448; 83/438; 83/465; 83/732; 193/35 SS; 269/238; 269/289 MR; 271/234; 271/251; 414/677

[58] Field of Search ..... 414/19, 677; 83/409, 83/410, 412, 414, 415, 438, 446, 447, 448, 465, 732; 271/234, 238, 240, 250, 251, 252; 269/238, 289 MR; 198/721; 193/35 MD, 35 SS

[56] References Cited

U.S. PATENT DOCUMENTS

| | | | |
|---|---|---|---|
| 553,159 | 1/1896 | Hollingsworth | 271/250 X |
| 1,973,749 | 9/1934 | Dawson | 271/251 |
| 2,464,173 | 3/1949 | Broadmeyer | 271/251 |
| 2,698,661 | 1/1955 | MacQuarrie | 83/446 |
| 3,001,787 | 9/1961 | Socke | 271/240 |
| 3,717,336 | 2/1973 | Short et al. | 271/251 X |
| 4,456,116 | 6/1984 | Jarman | 271/251 X |
| 4,553,795 | 11/1985 | Takagi | 193/35 SS |

*Primary Examiner*—Leslie J. Paperner

*Attorney, Agent, or Firm*—Karl F. Ross; Herbert Dubno

[57] ABSTRACT

A feed lever and a lateral stop with individual guide members spaced apart and arranged in slot-shaped grooves of the metal feed table supported so that they can be raised and lowered on a support. The guide members are each equipped with a guide body possessing a lateral stop in the form of a roller. These rollers come up against the edge to be guided of the sheet metal plate. A guide and clamping device is located alongside of each roller. The apparatus allows sheet metal plates to be accommodated, spaced apart from one another in several stacks, these sheet metal plates being cut at different locations on the cutting knife.

7 Claims, 2 Drawing Figures

RAISING AND LOWERING CONTROL MEANS
10
11
12
13
13a
14
14a
15
16
17
18
19
20
21
22
23
24
25
26
27
28
29
30
31
32
33
35
7

APPARATUS FOR POSITIONING OF SHEET METAL PLATES ARRANGED ON A METAL FEED TABLE OF A METAL SHEAR

FIELD OF THE INVENTION

The present invention relates to an apparatus for positioning of sheet metal plates arranged on a metal feed table of a metal shear.

BACKGROUND OF THE INVENTION

Apparatus for positioning are already known, and have a feed beam which interacts with a lateral stop arranged fixedly at the edge of the metal feed table perpendicularly to the cutting plane. The disadvantage of the known mechanisms is that the sheet metal plates guided along the lateral stop to the cutting knife are always cut at the same place, so that it is not possible to form several stacks of plate sections next to one another. Difficulties also arise when plate edges are trimmed, since the lateral stop causes an obstruction when the sheet metal plate is manipulated.

OBJECT OF THE INVENTION

The object of the invention is to provide an improved apparatus in which sheet metal plates can be cut at different locations on the cutting knife and the plate sections, spaced apart, can be accommodated in several stacks. Furthermore, it will become easier to manipulate the sheet metal plates because the lateral guide no longer causes any obstruction when the sheet metal plates are manipulated.

SUMMARY OF THE INVENTION

The proposed apparatus for positioning sheet metal plates arranged on a metal feed table of a metal shear comprises a feed lever extending parallel to the knives of the metal shear tranversely over the metal feed table and movable perpendicularly to the cutting plane, and with a lateral stop which extends along the metal feed table perpendicularly to the cutting plane and which is arranged so as to be movable parallel to the cutting plane, individual guide members of the lateral stop, which are spaced apart from one another, being arranged in slot-shaped grooves of the metal feed table and are longitudinally displaceable therein by means of a common support and can also be raised and lowered on said support, wherein each guide member is equipped with a guide body connected to said support and possessing at least one lateral stop in the form of a roller, against which the edge to be guided of the sheet metal plate comes to rest, a guide and clamping device for the sheet metal plate being located in front of the roller.

The proposed apparatus ensures that cutting can be carried out at different locations on the knife, the stacks being formed next to one another.

Since the guide members can be retracted, sufficient space remains, for example, to rotate the plate sections or to handle plate sections of different widths in succession.

Further features of the invention emerge from the description and from the drawings which belong to the subject of the invention either individually or in any comination.

BRIEF DESCRIPTION OF THE DRAWING

One embodiment of the invention will now be described in greater detail with reference to the accompanying drawing in which.

SPECIFIC DESCRIPTION

Figure 1:
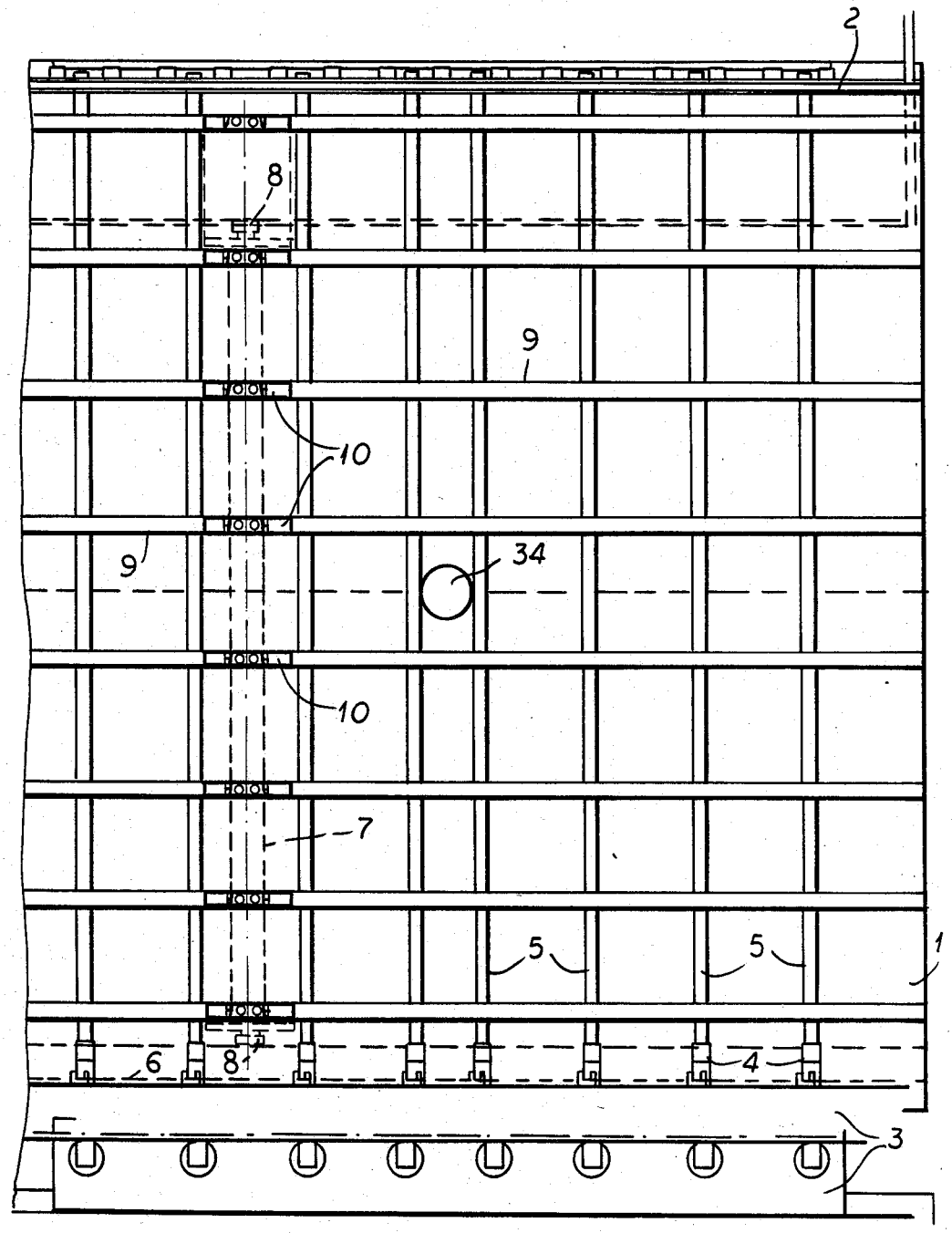
FIG. 1 is a plan view of the apparatus according to the invention illustrated diagrammatically.

Referring now to the drawing, there is provided a metal feed table 1 forming part of a metal cutting apparatus. At the rear end of the metal feed table 1 a fixed lower knife is fastened, the cutting edge 2 of this lower knife extending horizontally over the entire table width. The detailed design of the cutting device is known and is not shown in the drawing. At the other end of the metal feed table 1 opposite the cutting edge 2 is a feed lever 3. The feed lever 3 is equipped along its front edge with gripping members 4 each having an upper jaw and a lower jaw, between which the plate section to be positioned is grasped. The lower jaws are arranged somewhat below the surface of the metal feed table 1, while the upper jaws are located somewhat above it. To ensure easy movement of the feed lever 3, trench-like recesses 5 are provided for receiving the lower jaws of the gripping members 4, these recesses lying in the path of movement of the gripping members 4 and extending from the front edge 6 of the metal feed table 1 up to the cutting member.

Underneath the table 1 there is a support 7 which extends perpendicularly to the cutting plane and which is supported at each of its two ends in a rolling carriage 8 arranged so as to move to and fro parallel to the cutting plane.

Furthermore, in the metal feed table 1 there are slot-shaped grooves 9 arranged parallel to one another and to the cutting plane and receiving guide members 10 which are supported on the support 7 and which are designed so that they can be raised and lowered by control means 35 carried on support 7. Consequently, the guide members 10 are spaced apart from one another and as a result of the movement of the support 7 can be moved jointly, parallel to the cutting plane, in the corresponding slot-like grooves 9. In the lowered position, the guide members are located below the table surface, while in the raised position the guide members project above the table surface, as also described later.

Figure 2:
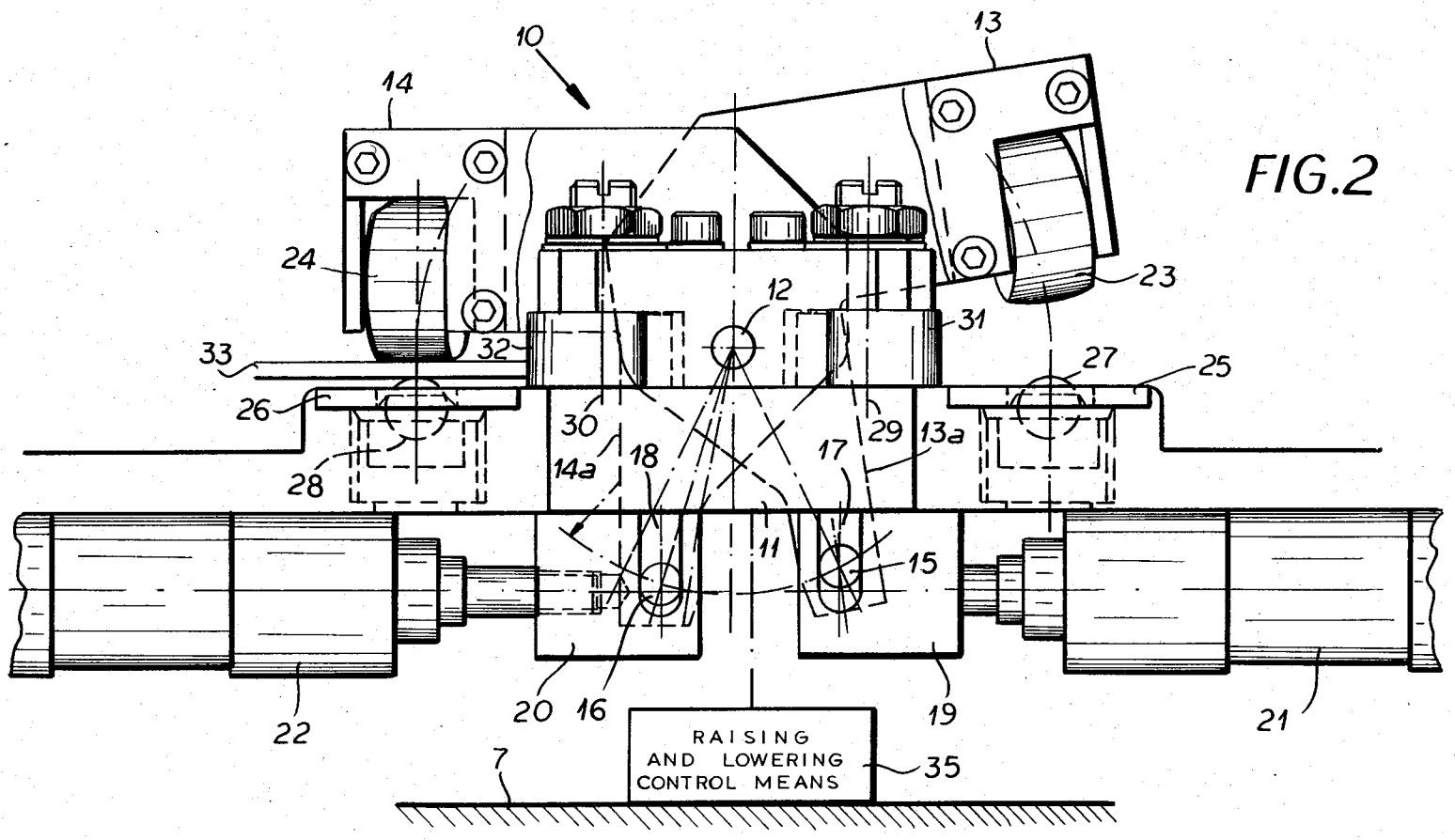
FIG. 2 shows a guide member in an enlarged elevational view.

FIG. 2 illustrates a guide member 10 which is made doublesided, so that the guide member can grasp and guide plate sections separately from one another both on the right-hand side and on the left-hand side.

The guide member has a guide body 11 which is mounted so that it can be raised and lowered on the support 7 by the control means 33. A retaining arm 13 pointing to the right and a further retaining arm 14 pointing to the left are fastend in the guide body 11 so as to be pivotable about a central horizontal shaft 12. The two retaining arms are made essentially L-shaped and are composed of an approximately horizontal leg and a vertical leg. The vertical legs **13*a*, 14*a* directed downwards are each provided with a horizontal guide pin 15, 16, and each of these is guided in a slot 17, 18 of a control head 19, 20 respectively. Each of the control heads is displaceable independently of the other by means of a separate hydraulic cylinder unit 21, 22, as a result of which the retaining arms 13 and 14** respectively are pivoted.

A pressure roller 23 is mounted in the horizontal leg of the retaining arm 13, and a pressure roller 24 is mounted in the corresponding leg of the retaining arm 14. The surfaces of the rollers 23 and 24 are cambered, and the axles of the rollers are somewhat inclined, so that the planes of rotation of the rollers each form an acute angle with the feed direction. Underneath each of the rollers 23 and 24 is located an abutment consisting of a plastic panel 25, 26, in which a ball 27 and 28 respectively is supported.

The guide member 10 is designed so that it is provided with a lateral stop both on the right-hand side and on the left-hand side. The lateral stops are formed by rollers which are mounted in the guide body 11, each so as to be rotatable about a vertical axis 29, 30, and which are designated by 31 and 32. As is evident from the drawing, the said rollers 31, 32 are located in the pivoting range of the presure rollers 23 and 24 respectively. Pivoting is achieved when the hydraulic cylinder units 21 and 22 respectively are actuated. As is evident from FIG. 2, the retaining arm 13 is in the upper pivoting position, in which the control head 19 has been retracted in the direction of the hydraulic cylinder unit 21. The guide pin 15 thereby slides in the slot 17 and causes pivoting into the position illustrated. In this position, the pressure roller 23 is lifted away from the ball 27 forming the abutment, so that the roller 31 forming a lateral stop is freely accessible.

The other pivoting position is shown on the left-hand side of FIG. 2. In this position, the leg of the retaining arm 14 carrying the pressure roller 24 is approximately horizontal, and the pressure roller 24 is located above the ball 28 forming the abutment. Between this pressure roller 24 and the ball 28 there is shown a plate section 33, the edge of which abuts against the roller 32 forming the lateral stop. The plate section 33 is under the influence of the feed lever 3 which pushes the plate section in front of it, the gripping members 4 of the feed beam remaining open. Since the pressure rollers 24 roll in a plane inclined relative to the center plane, a force is exerted constantly on the plate section which presses the plate section against the lateral stop roller 32.

It is also possible to clamp the plate section 33 between the roller 24 and the ball 28. To achieve this, the hydraulic cylinder unit is actuated in a second actuation stage which ensures that the pivoting force of the retaining arm 14 pressing on the ball 28 overcomes the resilient support of the ball 28, so that the ball is pressed into its mounting. The plate section 33 is thereby retained immovably on the plastic panel 26 surrounding the ball 28.

In a first possible use, a plate section is held by the gripping members 4 in the region of its rear edge and as a result of the movement of the feed lever 3 is displaced perpendicularly to the cutting plane in the direction of the knives. The support 7 is previously adjusted on the table 1, in such a way that a free longitudinal edge of the plate section comes to rest in the region of the first roller 31 or 32 of the first guide member 10. The appropriate adjustment of the support 7 is carried out as a result of displacement parallel to the cutting plane. When the feed lever 3 is actuated, the side edge of the plate section slides, for example, along the first roller 31 and afterwards comes into the region of the next roller 31. So that the feed beam 3 can be moved unimpeded in the feed direction towards the knives, the first guide member 10 is retracted below the surface of the table 1 at a suitable moment by means of a control, when the lifting device 35 is actuated. With a progressive forward movement of the feed lever 3, the corresponding edge of the plate section will slide along the rollers 31 in succession, the plate section sliding on the surface of the ball 27 projecting somewhat from the plane of the supporting table 1. Because the pressure rollers 23 are arranged so as to be inclined relative to the feed direction, the edge of the plate section is always pressed against the rollers 31 forming the lateral stop. Extremely accurate plate guidance is achieved in this way.

Two plate sections can be cut at the same time by means of the mechanism described, provided that they are narrower than half the table width.

As already mentioned, the guide members serve not only for exactly maintaining the perpendicular feed direction, but also for grasping plate sections during lateral displacement parallel to the knife plane. During such a movement, the drawn plate section must be clamped. For clamping, the hydraulic cylinder unit is operated at increased pressure, so that the ball 27 serving as an abutment is pressed into its mounting and the plate section is pressed onto the plastic panel 26 and retained there.

It may also be mentioned that a rotation device 34 is located in the center of the supporting table, and by means of the mechanism described the center of any sheet metal plate can be brought into the center of rotation. This would not be possible with a fixed lateral stop rail, since this allows a feed in one direction only.

We claim:

1. In an apparatus for positioning sheet metal plates arranged on a metal feed table of a metal shear, a feed lever extending parallel to knives of the metal shear transversely over the metal feed table and movable perpendicularly to a cutting plane, and with a lateral stop which extends along the metal feed table perpendicularly to the cutting plane and which is movable parallel to the cutting plane, individual guide members forming the lateral stop being spaced apart from one another, and arranged so as to be displaceable in slot-shaped grooves of the metal feed table by means of a common support and can be raised and lowered on said support, the improvement wherein each guide member is equipped with a guide boby connected to said support and provided with at least one lateral stop in the form of a roller against which an edge to be guided of a sheet metal plate comes to rest, and a guide and clamping device for gripping the sheet metal plate located alongside of the roller.

2. The apparatus defined in claim 1, wherein the guide and clamping device is formed by a pivotable pressure roller coacting with an abutment located under the roller and formed by a ball mounted in a plastic panel.

3. The apparatus defined in claim 2, wherein the pressure roller is mounted on an L-shaped retaining arm which is mounted pivotably on the guide body and which is operated by a hydraulic control and actuation member.

4. The apparatus defined in claim 3, wherein the retaining arm has two working positions, in the first position of which the sheet metal plate is guided movably between the pressure roller and the ball of the abutment and in the second position of which the sheet metal plate is clamped between the pressure roller and an upper surface of the plastic panel of the abutment.

5. The apparatus defined in claim 4, wherein the ball of the abutment is supported resiliently in a recess of the plastic panel, whereby a portion of the ball projects from the upper surface of the plastic panel and in this position forms a rolling base for the sheet metal plate.

6. The apparatus defined in claim 5, wherein in the second position of the retaining arm, a force exerted by the pressure roller on the ball of the abutment is greater than the resilient force exerted on the ball.

7. The apparatus defined in claim 6, wherein the plane of rotation of the pressure roller forms an acute angle with a feed direction of the sheet metal plate.

* * * * *